US005398763A

United States Patent [19]

Watson et al.

[11] Patent Number: 5,398,763

[45] Date of Patent: Mar. 21, 1995

[54] WIRELINE SET BAFFLE AND METHOD OF SETTING THEREOF

[75] Inventors: Brock W. Watson, Duncan, Okla.; James F. Pyecroft, Mt. Pleasant, Mich.; David D. Brisco, Duncan, Okla.; Rick L. Middaugh, Edmond, Okla.; Paul W. Roden, Pauls Valley, Okla.; Donald F. Hushbeck, Duncan, Okla.; J. Tad Bohlen, Duncan, Okla.; Ronald E. Savage, Duncan, Okla.

[73] Assignee: Halliburton Company, Duncan, Okla.

[21] Appl. No.: 40,789

[22] Filed: Mar. 31, 1993

[51] Int. Cl.[6] ..... E21B 23/02

[52] U.S. Cl. ..... 166/382; 166/162; 166/208; 166/242

[58] Field of Search ..... 166/387, 382, 305.1, 166/289, 299, 117, 162, 208, 242, 243

[56] References Cited

U.S. PATENT DOCUMENTS

| | | | |
|---|---|---|---|
| 3,289,762 | 12/1966 | Schell et al. | 166/35 |
| 3,768,562 | 10/1973 | Baker | 166/289 |
| 3,811,500 | 5/1974 | Morrisett et al. | 166/154 |
| 3,948,322 | 4/1976 | Baker | 166/289 |
| 4,250,966 | 2/1981 | Streich et al. | 166/328 |
| 4,637,468 | 1/1987 | Derrick | 166/133 X |
| 4,664,192 | 5/1987 | Hogarth | 166/291 |

OTHER PUBLICATIONS

Halliburton Services Sales & Service Catalog No. 43 (1985), pp. 2412, 2442, 2444–2446 and 2509–2510.

*Primary Examiner*—Terry Lee Melius

*Attorney, Agent, or Firm*—Stephen R. Christian; Neal R. Kennedy

[57] ABSTRACT

A wireline set baffle for positioning in a well casing after the well casing has already been placed in a wellbore. The apparatus comprises a baffle and a setting or running tool engaged with the baffle and adapted for positioning the baffle at a predetermined location in the wellbore. In one embodiment, a lock ring may be used to lock the baffle to the casing at a predetermined location, and in another embodiment, collet fingers on the baffle may be used to engage the casing. The lock ring may be initially held in a non-engaging position by a lock ring retainer or shear pins. The collet fingers may be initially held in a non-engaging position by a cover which is disengaged from the collet fingers by a blasting cap. Engagement may be with an inner surface of the casing or a recess defined at a casing joint. A method of using the wireline set baffle is also disclosed.

33 Claims, 6 Drawing Sheets

WIRELINE SET BAFFLE AND METHOD OF SETTING THEREOF

BACKGROUND OF THE INVENTION

1. Field Of The Invention

This invention relates to baffles positioned in well casing and used for such operations as fracturing and treating, and more particularly, to a baffle which may be set on a wireline. In some embodiments, the baffle is retrievable.

2. Description Of The Prior Art

In multiple stage fracturing jobs in oil and gas wells, one or more tubing or casing baffles are positioned in the completion string between the well zones which are to be stimulated. Proper placement of the fracturing baffles in the production casing permits accurate control of fluid entry into the zone or zones to be fractured.

Each zone may be perforated, fractured and then temporarily isolated with a bridging ball while a more shallow zone is being completed in a similar manner. Thus, a multiple stage fracturing operation usually can be completed in a semi-continuous manner allowing for the short time delay required to perforate each zone before treatment.

Such casing baffles, which have been in wide use for a number of years, are installed as the casing is made up and run into the hole. The baffles have graduated internal openings, and sealing balls or free-fall plugs are selected and mated with the baffles so that the smaller diameter balls or plugs will pass through the larger baffles that are installed at the more shallow depths. The balls and plugs are of such density that they usually are expelled from the tubing with the flow of fluids and gas when the well is opened to test or production.

When this method is used, pin-point stage fracturing of massive oil or gas production zones usually can be achieved rapidly and economically with less time required than when using bridge plugs, straddle packers, and other conventional tools for multiple zone isolation.

As mentioned, these previously known baffles require placement of the baffle in the casing while the casing string is assembled and run into the well bore. This obviously requires preplanning. In addition, the baffles in the casing may limit the use of perforation isolation packers, such as the Halliburton pin point injection packer. Another problem is that some operations do not have the drilling supervision necessary to insure the baffle is placed at the required point in the casing string. Such supervision usually requires a geologist who can pick the point in the open hole and a drilling foreman to insure the baffle is placed between the correct casing joints. In some cases, there is a relatively small distance between zones, and if the casing tally or driller's total depth measurement is off, the baffles may be placed in such a position that other multiple stage fracturing methods have to be employed. Errors of one hundred feet are not uncommon in pipe tally or driller's total depth measurements, and there are known zones in which the depth between zones is only forty to sixty feet.

The wireline set baffle of the present invention may be positioned in the casing string above a fracture interval after the casing is already in the well bore. It is not necessary to install the present baffle beforehand. The baffle of the present invention may be run on an electric wireline, slick-line, sand-line, tubing or coiled tubing. With any of these techniques, the baffle may be accurately placed and no preplanning of its placement prior to cementing is required.

Another problem with prior art baffles is that they become a permanent portion of the casing string and may not be retrieved. In the present invention, some of the embodiments of the baffle are retrievable.

SUMMARY OF THE INVENTION

The wireline set baffle of the present invention is adapted for positioning in a well casing after the well casing has already been placed in a wellbore. That is, it is not necessary to install the baffle as the casing string is being made up. The baffle may be set on a wireline, tubing string, or other such means. In at least some embodiments, the baffle may be retrieved from the casing.

The baffle is run into the well casing as part of a baffle apparatus or assembly comprising the baffle and a setting or running tool engaged with the baffle and adapted for releasing the baffle at a predetermined location in the well casing. The apparatus further comprises engaging means for engaging the casing in the well casing and holding the baffle in an operating position. A retaining means is provided for retaining the engaging means in a non-engaging position and releasing the engaging means to a casing engaging position when the apparatus is in the predetermined location.

In one embodiment, the engaging means is characterized by a lock ring disposed adjacent to the baffle for engaging a recess defined between adjacent casing sections forming a portion of a casing joint. In one embodiment, the retaining means comprises a lock ring retainer disposed around the lock ring for retaining the lock ring in the retracted position. The lock ring retainer is movable with respect to the lock ring for releasing the lock ring to the engaging position. In another embodiment, the retaining means is characterized by a shear pin initially holding the lock ring to the setting tool.

In still another embodiment, the engaging means is characterized by collet fingers extending from the baffle for engaging the recess defined between adjacent casing sections forming a portion of the casing joint. This embodiment also comprises a retaining means for retaining the collet fingers in a retracted position and releasing the collet fingers to a casing joint engaging position when the apparatus is in the predetermined position in the well casing. This retaining means may comprise a cover engaging and holding the collet fingers in the retracted position and releasing means for disengaging the cover from the collet fingers so that the collet fingers are free to engage the recess. This releasing means may comprise a blasting cap for fracturing the cover when the blasting cap is fired.

In a further embodiment of the invention, the engaging means is adapted for simply engaging the wall of the casing and not necessarily a recess defined at a casing joint. However, this embodiment may be used to engage such recess.

The apparatus may further comprise retrieving means for disengaging the engaging means from the casing so that the baffle may be removed from the well casing. For the embodiment of the engaging means which is a radially outwardly biased lock ring, the retrieving means may be characterized by a retrieving ring for engaging and radially inwardly compressing the lock ring to a disengaged, retracted position. In the embodiment in which the engaging means is characterized by radially outwardly biased collet fingers, the retrieving means may be characterized by a chamfered surface on the collet fingers. Application of an upward force on the collet fingers disengages the collet fingers from the recess.

The apparatus may further comprise sealing means for sealing between the baffle and the well casing.

The apparatus may also further comprise a tool, such as a plug, packer or bridge plug, for engaging the baffle after the baffle is released and the engaging means is engaged at the predetermined location in the well casing. The tool is adapted for preventing or controlling fluid flow past the baffle. In one embodiment, the tool is characterized by a plug which comprises a bypass passageway therein for bypassing fluid past the baffle when the plug is in a bypassing position.

Additional objects and advantages of the invention will become apparent as the following detailed description of the preferred embodiments is read in conjunction with the drawings which illustrate such embodiments.

DESCRIPTION OF THE PREFERRED EMBODIMENTS

FIRST EMBODIMENT

Figure 1:
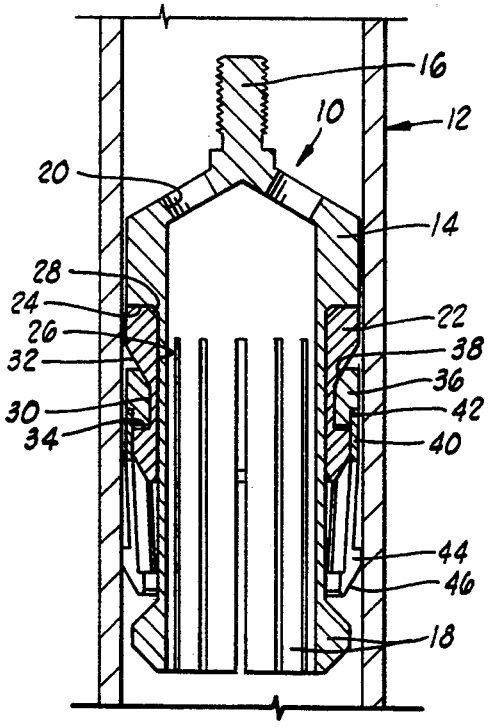
FIG. 1 shows a first embodiment of the wireline set baffle of the present invention as part of a baffle assembly as it is run into a well casing string.

Referring now to the drawings, and more particularly to FIG. 1, the first embodiment of the wireline set baffle of the present invention is shown forming a portion of a wireline set baffle assemby generally designated by the numeral 10. Assembly 10 is illustrated in the configuration in which it is run into a well casing 12.

First embodiment assembly 10 as shown in FIG. 1 includes a running or setting tool 14 having an upper end 16 adapted for connection to a running means, such as a wireline. At the lower end of running tool 10 are a plurality of collet fingers 18 which are adapted for inward deflection when necessary. Running tool 10 also defines a plurality of bypass ports 20 therethrough.

A wireline set baffle 22 is disposed around running tool 10 and is positioned adjacent to a shoulder 24 on the running tool. Baffle 22 has a bore 26 therethrough with a chamfer 28 at the upper end thereof.

Baffle 22 defines an outwardly facing groove 30 therein with a chamfered surface 32 at the upper end thereof and a shoulder 34 at the lower end thereof. An outwardly biased lock ring 36 is disposed in groove 30 and has a chamfered inner surface 38 which corresponds to chamfer 32 in groove 30. Lock ring 36 is one embodiment of an engaging means for engaging a casing joint in well casing 12 as will be further described herein.

The upper end of a lock ring retainer 40 engages an outer surface 42 on lock ring 36 and initially holds the lock ring out of engagement with casing 12. The lower end of lock ring retainer 40 comprises a plurality of collet fingers 44 which are in engagement with, and inwardly deflected by, casing 12 as the tool is run into the well bore. At the lower end of collet fingers 44 is a chamfered surface 46.

Lock ring retainer 40 characterizes one embodiment of a retaining means for retaining lock ring 36 in a retracted position and thereafter releasing the lock ring to a casing joint engaging position when first embodiment assembly 10 is in a predetermined location in the well bore. This operation will be further described herein.

As seen in FIG. 1, first embodiment apparatus 10 is in the configuration in which it is run into casing 12. As the tool is run into the well bore, fluid is bypassed through bypass ports 20.

Figure 2:
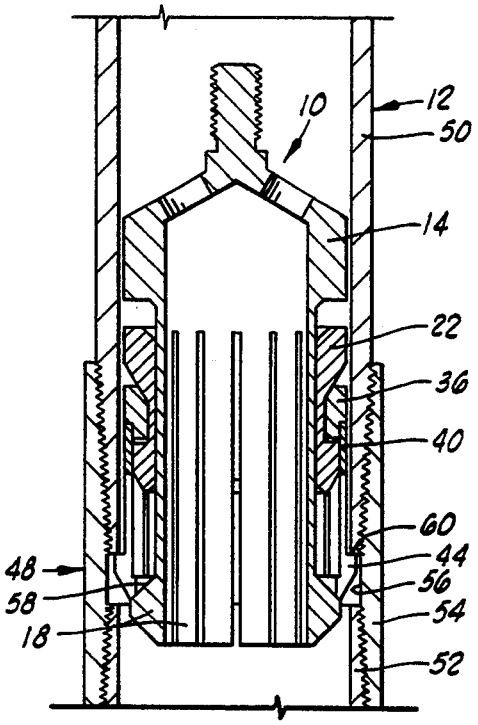
FIGS. 2–7 illustrate operation of the first embodiment shown in FIG. 1.

First embodiment baffle assembly 10 is adapted for positioning adjacent to a predetermined casing joint 62 in casing 12. The tool is run downwardly past this desired joint until it reaches the next lower joint generally indicated by the numeral 48 in FIG. 2. Joint 48 is formed by the threaded engagement of a pair of casing sections 50 and 52 with a casing collar 54 in a manner known in the art. In this way, a recess 56 is defined between casing sections 50 and 52. When wireline set baffle assembly 10 is lowered adjacent to recess 56, the lower ends of collet fingers 44 on lock ring retainer 40 spring outwardly to engage the recess, as seen in FIG. 2. By lifting up slightly on the wireline, chamfered surface 58 on collet fingers 18 of running tool 14 engage collet fingers 44 on lock ring retainer 40 and help force collet fingers 44 outwardly to engage recess 56.

Figure 3:
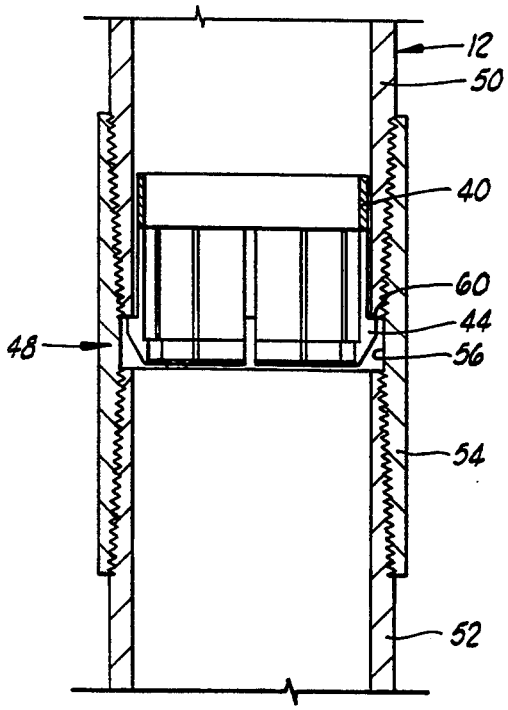
Figure 4:
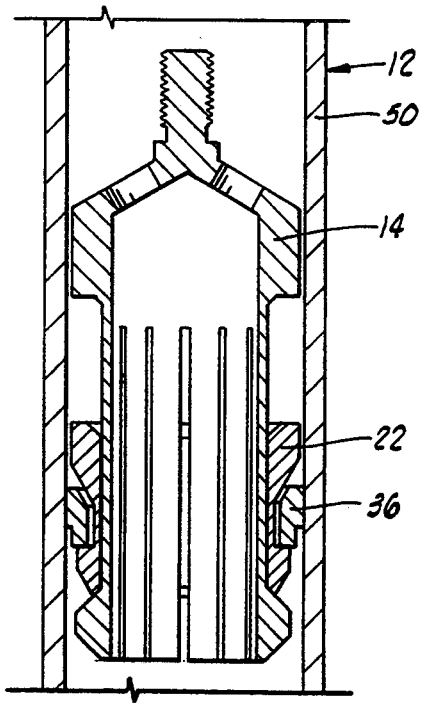

By further lifting on the wireline, running tool 14 may be removed from lock ring retainer 40. Chamfered surface 58 on collet fingers 18 force collet fingers 18 inwardly so that the running tool may be lifted up further. The engagement of shoulder 60 with the lower end of casing section 50 prevents lock ring retainer 40 from being moved with running tool 14. It will be seen by those skilled in the art that baffle 22 and lock ring 36 will move upwardly with running tool 14. In this way, lock ring retainer 40 may be left in, and engaged with, casing joint 48 as seen in FIG. 3. Now referring to FIG. 4, running tool 14 with baffle 22 and lock ring 36 thereon may be moved upwardly to desired casing joint 62. After lock ring retainer 40 has been disengaged, lock ring 36 is released and therefore free to expand radially outwardly until it engages the inner bore of casing section 50 of casing 12.

Figure 5:
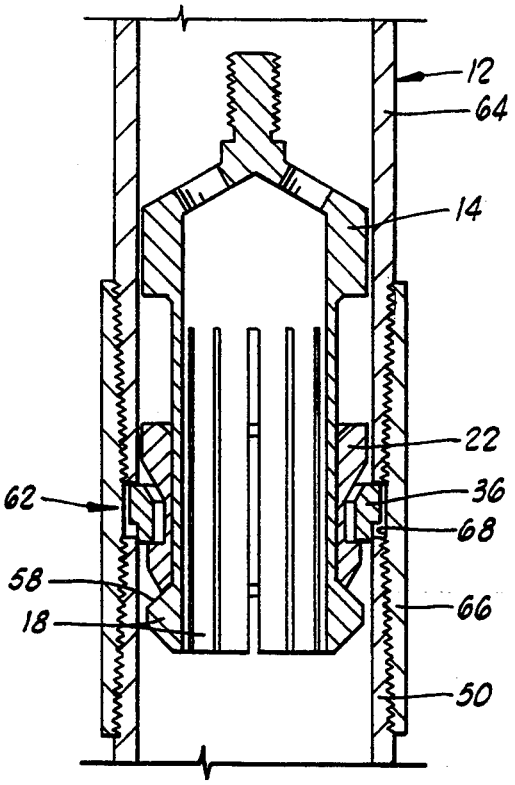

Referring now to FIG. 5, assembly 10 is moved upwardly to the next higher casing joint 62 which is formed by the engagement of casing sections 64 and 50 with casing collar 66. Lock ring 66 expands outwardly to engage recess 68 formed in casing joint 62.

Figure 6:
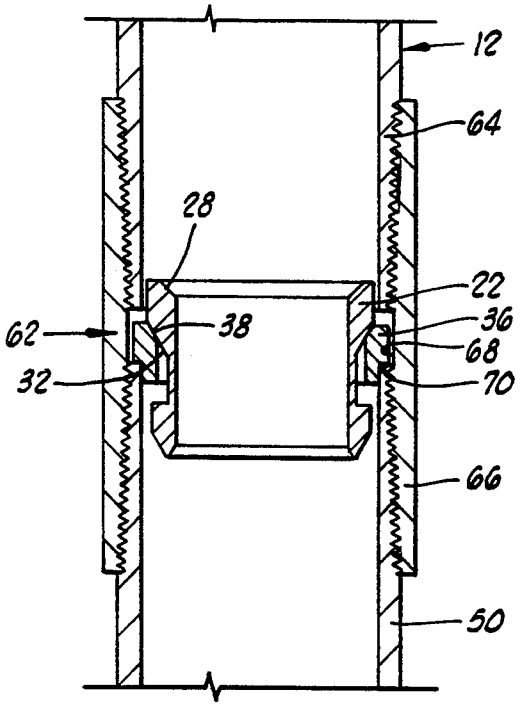
Figure 7:
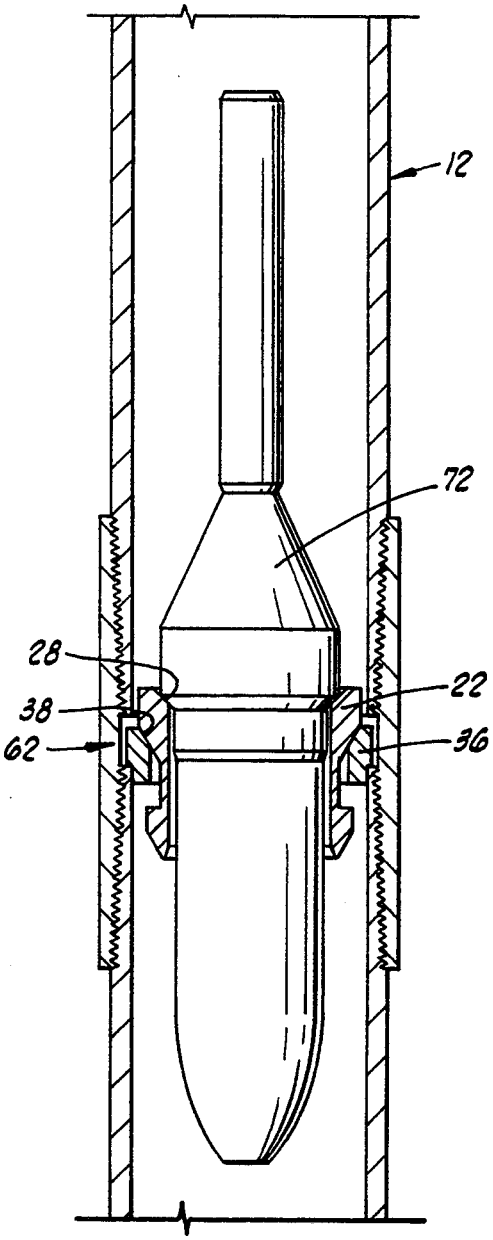

At this point, further lifting on running tool 14 will cause collet fingers 18 to be inwardly deflected with respect to baffle 22 so that the running tool may be lifted out of the baffle. In this way, baffle 22 with lock ring 36 disposed therearound and engaged with casing joint 62 are left in casing 12 at the desired location as shown in FIG. 6. A shoulder 70 on lock ring 36 prevents downward movement of the lock ring and baffle 22.

A sealing means, such as a free-fall plug 72 may be dropped down casing 12 so that it will land on baffle 22 and prevent fluid from passing therebelow. The engagement of free-fall plug 72 with chamfer 28 in baffle 22 is of a kind known in the art, and the free-fall plug may be retrieved as desired.

In an alternate embodiment, baffle 22 may simply be eliminated so that running tool 14 is used to position lock ring 36 adjacent to the predesired casing joint so that lock ring 36 essentially acts as a baffle of larger diameter. In this case, the free-fall plug or ball will engage chamfer 38 in lock ring 36 rather than chamfer 28 in baffle 22.

A method of fracturing using wireline set apparatus 10 may be described as comprising the following steps:

1. Placing acid in casing 12 during a cement job by pumping acid behind a cement displacement plug. This step is not always required, but it can lower the breakdown pressures prior to fracturing. This step may also help remove cement which can form in the casing collars.

2. Rigging up wireline perforating equipment and running a correlation log with gamma ray and collar locator.

3. Perforating the zone to be fractured.

4. Rigging up fracturing stimulation pump equipment.

5. Pressuring up casing 12 and breaking down the perforations.

6. Pumping fracture stimulation treatment as required.

7. Displacing the fracture treatment with hydrochloric acid if desired for breaking down the upper formation. The acid should be placed at the next perforation interval and above.

8. Closing full opening pressure control valve and rigging down fracture well head equipment if necessary.

9. Rigging up wireline perforating equipment with lubricator and pressure control equipment as needed. For example, this equipment might include a packoff or grease injector.

10. Determining the casing collar in which to set the wireline set baffle. This is determined from information in the correlation log.

11. Opening the full opening pressure control valve.

12. Running in hole with the wireline and wireline set baffle assembly to the first casing joint 48 below the predetermined casing joint 62.

13. Engaging the collet fingers in this lower collar and pulling out of the hole with the wireline.

14. Collet fingers 44 will engage lower casing collar 48 and separate from wireline baffle 22 as previously described. Note: Lock ring retainer 40 may be made of an acid soluble material, such as aluminum, so that it can be dissolved if desired.

15. Continuing to pull out of the hole with the wireline and allowing lock ring 36 to engage the predetermined casing joint 62.

16. Pulling out of the hole with approximately 1,000 pounds force over the weight of the wireline assembly to pull collet fingers 18 on running tool 14 through baffle 22 and continuing to pull out of the hole with a wireline, leaving baffle 22 in casing joint 62 as previously described.

17. Perforating the next zone. The tool may be modified to permit conveyance of baffle 22 to the predetermined casing joint 62 with a perforating gun. This will save time and allow one trip into the hole where two would normally be required.

18. Pulling out of the hole with the wireline.

19. Closing the full opening pressure control valve and placing either a multi-stage frac ball or multi-stage free-fall frac plug on top of the valve.

20. Rigging up the lubricator if required.

21. Opening the full opening pressure control valve, thereby allowing the multi-stage frac ball or multi-stage free-fall frac plug to fall to baffle 22, as previously described.

22. Closing the full opening pressure control valve and rigging up the fracture equipment.

23. Repeating steps 5–22 for each subsequent fracturing treatment. If using a multi-stage free-fall frac plug with retrieving stud, this step may also include recovering the free-fall frac plug before performing subsequent fracturing treatments. If using a multi-stage frac ball, this step would include flowing the well back and recovering the ball prior to subsequent fracturing treatments.

Other methods may be used.

SECOND EMBODIMENT

Figure 8:
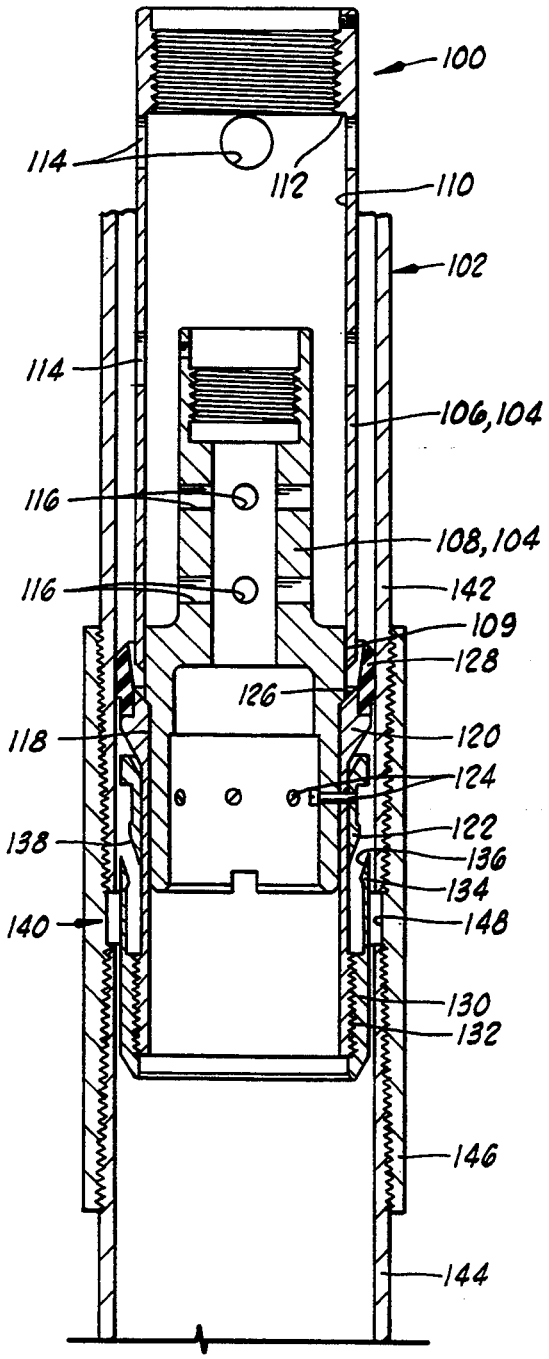
FIG. 8 shows a second embodiment of the wireline set baffle of the present invention in a baffle assembly as it is run into the casing string.
Figure 9:
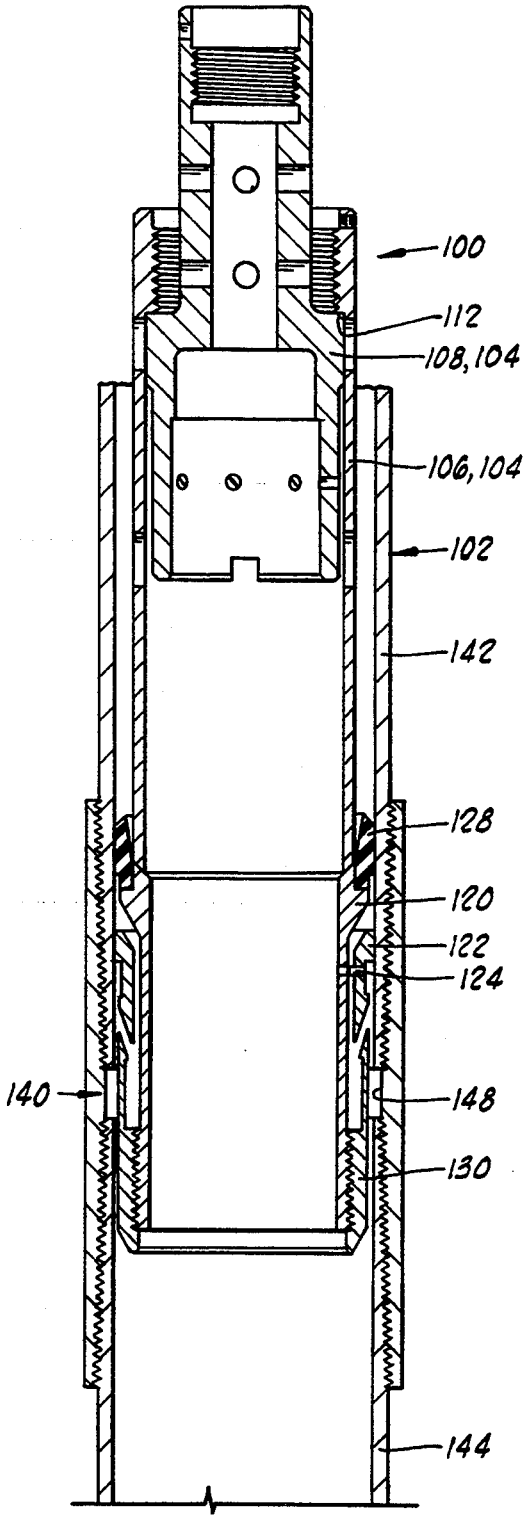
FIGS. 9 and 10 illustrate operation of the second embodiment.
Figure 10:
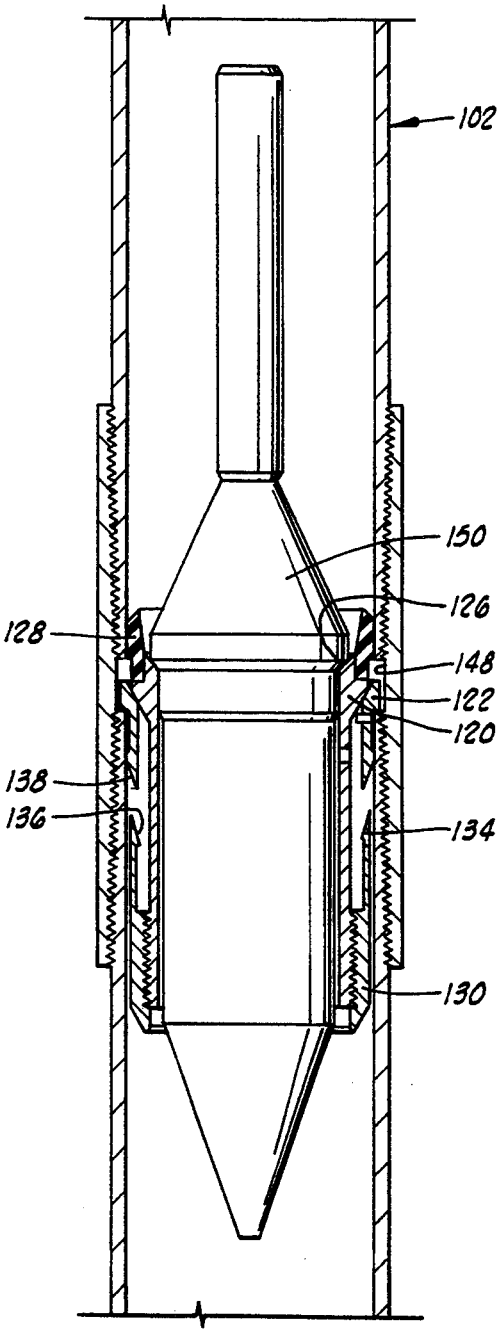

Referring now to FIGS. 8–10, a second embodiment wireline set baffle assembly is shown and generally designated by the numeral 100. Second embodiment 100 is positionable in a casing string 102. Second embodiment 100 is shown as it is run into casing 102 in FIG. 8.

Second embodiment 100 comprises a setting or running tool 104 of a kind known in the art, such as a GO or Baker wireline setting tool. Setting tool 104 includes an outer sleeve portion 106 and an inner mandrel portion 108 having an outside diameter 109 which is slidably received in bore 110 in sleeve 106. At the upper end of bore 110 is a shoulder 112. Sleeve 106 defines a plurality of bypass ports 114 therethrough.

Mandrel 108 has a plurality of bypass ports 116 therethrough. At its lower end, mandrel 108 has a second outside diameter 118. A baffle 120 is disposed on second outside diameter 118 of mandrel 108. A radially outwardly biased lock ring 122 is disposed on the outside of baffle 120. Lock ring 122 is another embodiment of an engaging means for engaging a casing joint in well casing 102 as will be further described.

A shear means, such as a plurality of shear pins 124, hold baffle 120 and lock ring 122 in position with respect to mandrel 108 of setting tool 104. In the initial position shown in FIG. 8, lock ring 122 is retained inwardly by shear pins 124 so that it cannot move outwardly and engage casing 102. Shear pins 124 thus characterize a retaining means for retaining lock ring 122 in a retracted position and, upon shearing, releasing the lock ring to a casing joint engaging position when second embodiment assembly 100 is in a predetermined location in well casing 102.

Baffle 122 has an upwardly facing chamfered surface 126 therein. A sealing means, such as seal 128, is attached to baffle 120 and provides sealing engagement between the baffle and casing 102.

The lower end of baffle 120 is attached to a retrieving ring 130 at threaded connection 132. Retrieving ring 130 has an upwardly extending annular portion 134 with an upwardly facing chamfered surface 136 therein. Chamfered surface 136 generally faces and corresponds to a downwardly facing chamfered surface 138 at the lower end of lock ring 122.

Second embodiment apparatus 100 is adapted for positioning baffle 120 adjacent to a predetermined casing joint 140 formed by the engagement of a pair of casing sections 142 and 144 with a casing collar 146. A recess 148 will be seen to be formed between the ends of casing sections 142 and 144 in a manner known in the art.

When second embodiment apparatus 100 is positioned adjacent to, and slightly above, casing joint 140, setting tool 104 is fired in a manner known in the art. After firing, mandrel 108 is moved upwardly with respect to sleeve 106 until the mandrel engages shoulder 112 in the sleeve. It will be seen that this shears shear pins 124 which releases lock ring 122 so that it expands outwardly to engage casing 102. The apparatus is then in the position shown in FIG. 9.

Baffle 120 may then be pushed downwardly until lock ring 122 is aligned with recess 148 in casing joint 140 so that the lock ring springs outwardly to engage recess 148, as seen in FIG. 10. Setting tool 104 may then be raised out of the well bore so the baffle 120 and lock ring 122 remain in casing 102.

As with first embodiment 10, a free-fall plug 150 or ball may be dropped down to engage chamfer 126 in baffle 120 so that fluid flow downwardly past the baffle is prevented. A method of fracturing using wireline set apparatus 100 is similar to that previously described for first embodiment apparatus 10. However, it is not necessary to move the apparatus to the casing joint below the desired casing joint.

In second embodiment 100, after plug 150 has been removed, baffle 120 may be retrieved by a retrieving tool (not shown) which engages the baffle so that it can be pulled upwardly. The retrieving tool may be of any kind generally known in the art. By lifting on baffle 120, retrieving ring 130 is moved upwardly so that chamfered surface 136 in annular portion 134 thereof engages chamfered surface 138 on lock ring 122. Further lifting will be seen to compress lock ring 122 radially inwardly so that it is no longer engaged with recess 148. At this point, the retrieving tool, baffle 120 and lock ring 122 may then be lifted out of casing 102. Thus, a retrieving means is provided for disengaging lock ring 122 from casing joint 140 so that baffle 120, along with the lock ring, may be removed from well casing 102.

THIRD EMBODIMENT

Figure 11:
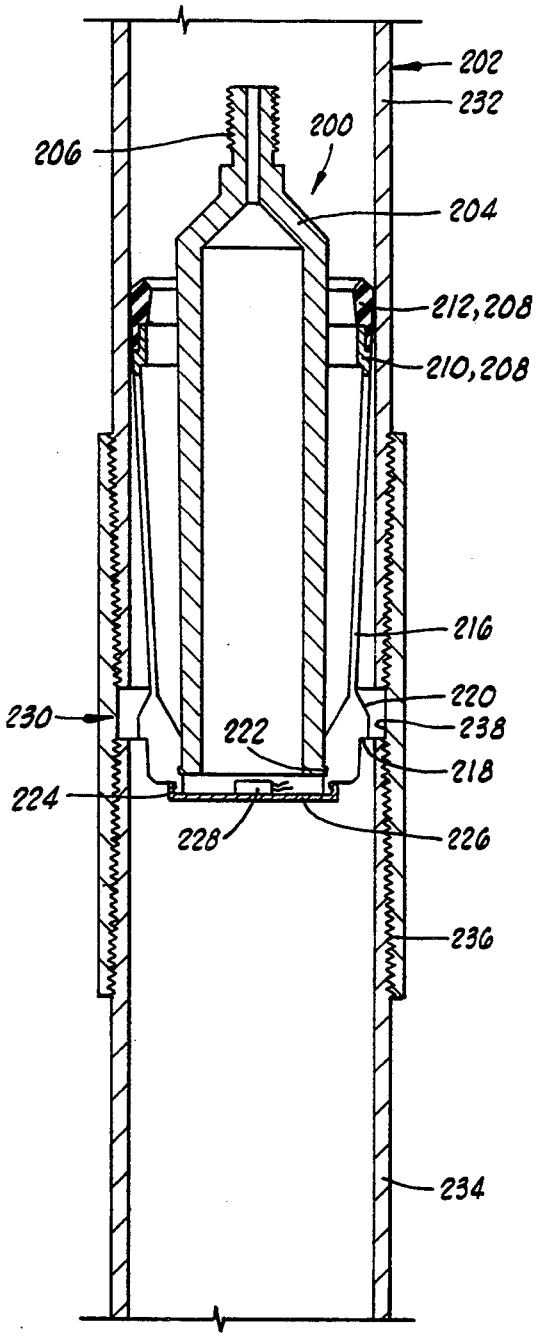
FIG. 11 shows a third embodiment of the wireline set baffle of the present invention in a baffle assembly.
Figure 12:
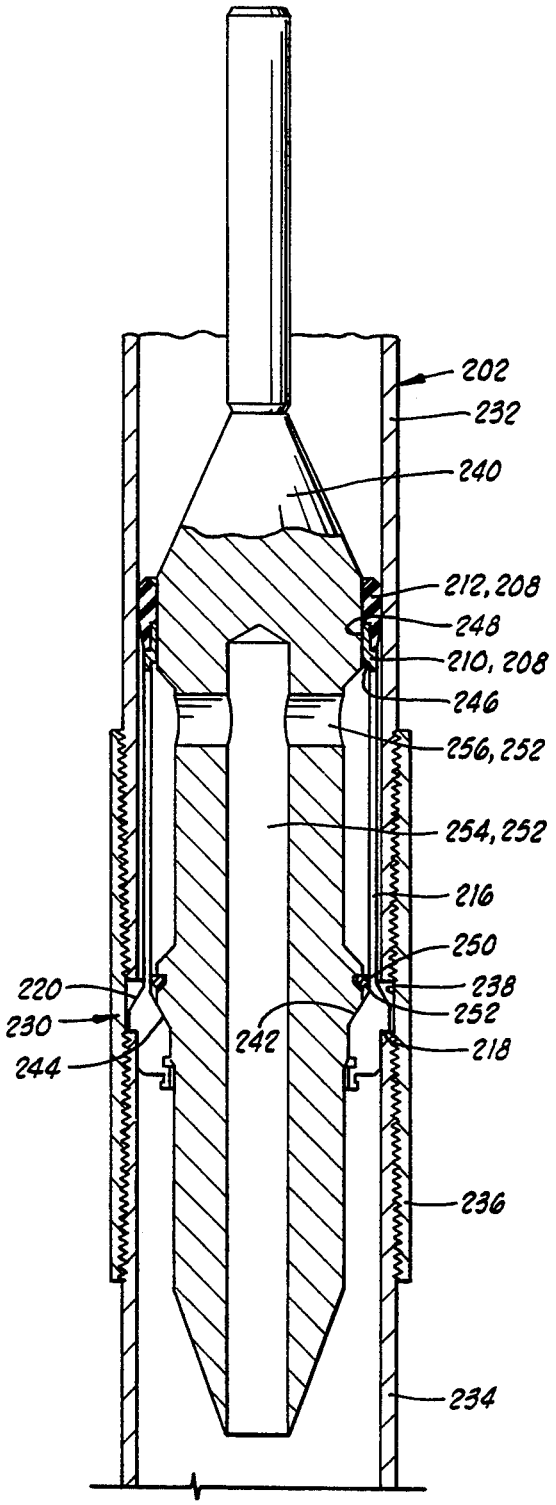
FIGS. 12 and 13 illustrate operation of the third embodiment.
Figure 13:
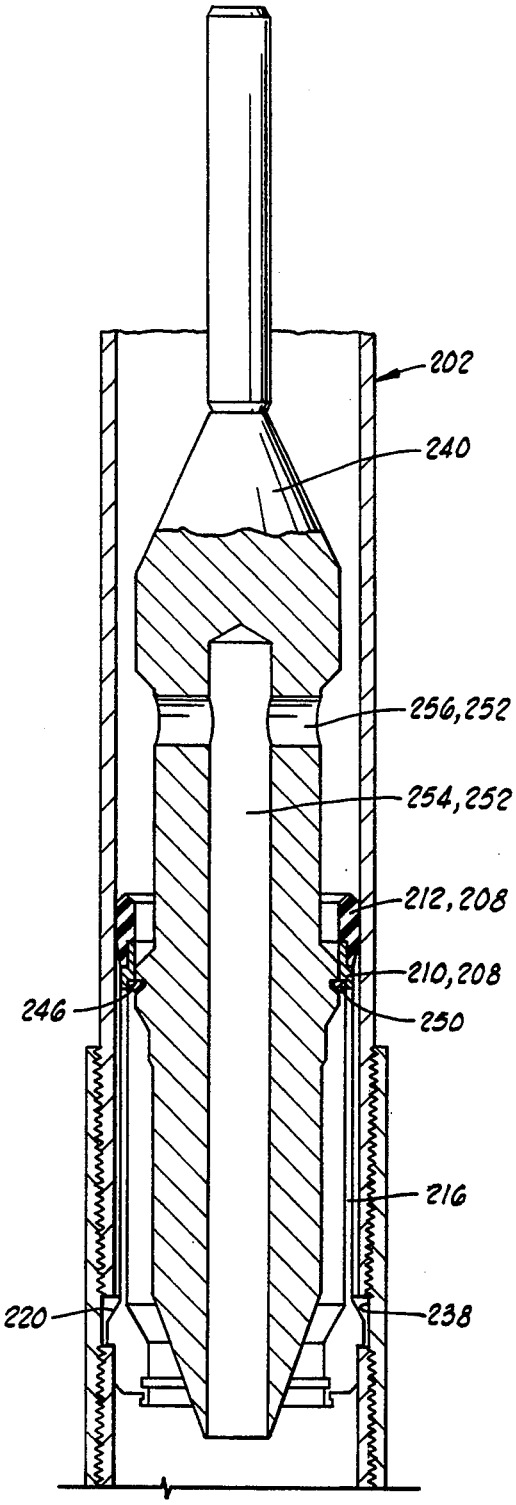

Referring now to FIGS. 11–13, a third embodiment wireline set baffle assembly is shown and generally designated by the numeral 200. Third embodiment apparatus 200 is adapted for use in a well casing 202.

Third embodiment wireline set baffle apparatus 200 comprises a setting or running tool 204 having an upper end 206 adapted for attachment to a wireline in a manner as previously described.

A baffle 208 is disposed around setting tool 204. Baffle 208 comprises a collet 210 with a sealing means, such as seal 212, attached to the upper end thereof. Seal 212 is adapted for sealing engagement with casing 202.

Collet 210 has a plurality of downwardly extending collet fingers 216 with lower ends having a downwardly facing shoulder 218 and an upwardly facing chamfered surface 220 thereon. Initially, collet fingers 216 are deflected inwardly such that a groove 222 in the lower end of the collet fingers is engaged by a radially outwardly extending flange 224 on setting tool 204. As further described herein, collet fingers 216 will be seen to characterize an engaging means for engaging a casing joint in well casing 102.

The lower ends of collet fingers 216 are held in this inwardly deflected position by a cover 226. Cover 226 characterizes a retaining means for retaining collet fingers 216 in a retracted position and releasing the collet fingers to a casing joint engaging position when third embodiment assembly 200 is in a predetermined location in well casing 202.

A blasting cap 228 is positioned adjacent to cover 226.

In operation, third embodiment wireline set baffle assembly 200 is lowered into casing 202 adjacent to a predetermined casing joint 230. Casing joint 230 is formed, in a manner to that previously described, by the engagement of casing sections 232 and 234 with a casing collar 236. A recess 238 is defined in casing joint 230 between the ends of casing sections 232 and 234.

When third embodiment 200 has been so positioned, blasting cap 228 is set off, thereby shattering the brittle material of cover 226. The lower ends of collet fingers 216 are then free to spring radially outwardly to engage recess 238. The pieces of blasting cap 228 and cover 226 merely fall to the bottom of the wellbore. It will be seen that baffle 208 is thus totally disengaged from setting tool 204, and the setting tool may be removed from casing 202.

Downward movement of baffle assembly 208 is prevented by the engagement of shoulder 218 on collet fingers 216 with the upper end of casing section 234.

A free-fall plug 240 may be dropped through casing 202 to engage inner upwardly facing chamfer 242 on the lower ends of collet fingers 216. A chamfer 244 on plug 240 engages chamfers 242. Sealing engagement between plug 240 and casing 202 is provided by seal 212 of baffle assembly 208 so that fluid flow downwardly past plug 240 and baffle assembly 208 is prevented. This is illustrated in FIG. 12.

The upper end of collet 210 has downwardly facing shoulder 246 defined therein at the lower end of a bore 248 therethrough.

Just above chamfer 244 on plug 240 is an outwardly biased lock ring 250. Lock ring 250 has a downwardly facing chamfered shoulder 252 thereon. As free-fall plug 240 is dropped downwardly, chamfer 252 allows lock ring 250 to be compressed radially inwardly so that lock ring 250 will pass through bore 248 in collet 210 of baffle assembly 208. After lock ring 250 passes downwardly past shoulder 246, it will spring radially outwardly.

In one embodiment, free-fall plug 240 has a bypass passageway 252 therein. Bypass passageway 252 is formed by a longitudinal hole 254 which is intersected by a transverse hole 256. By lifting on free-fall plug 240 such that lock ring 250 is brought upwardly adjacent to shoulder 246 in collet 210 of baffle assembly 208, it will be seen that fluid may flow downwardly through casing 222, through bypass passageway 252, and thus below baffle assembly 208.

This bypass feature also allows easy retrieval of plug 240 and baffle assembly 208. By further lifting on plug 240, the engagement of lock ring 250 with shoulder 246 in collet 210 will apply the upward force to baffle assembly 208. The engagement of chamfered surface 220 on the lower ends of collet fingers 216 will force the collet fingers radially inwardly so that they are disengaged from recess 238. It will be seen by those skilled in the art that plug 240 and baffle assembly 208 may then be lifted out of casing 202.

A method of fracturing using wireline set baffle apparatus 200 is similar to that for second embodiment apparatus 100.

FOURTH EMBODIMENT

Figure 14:
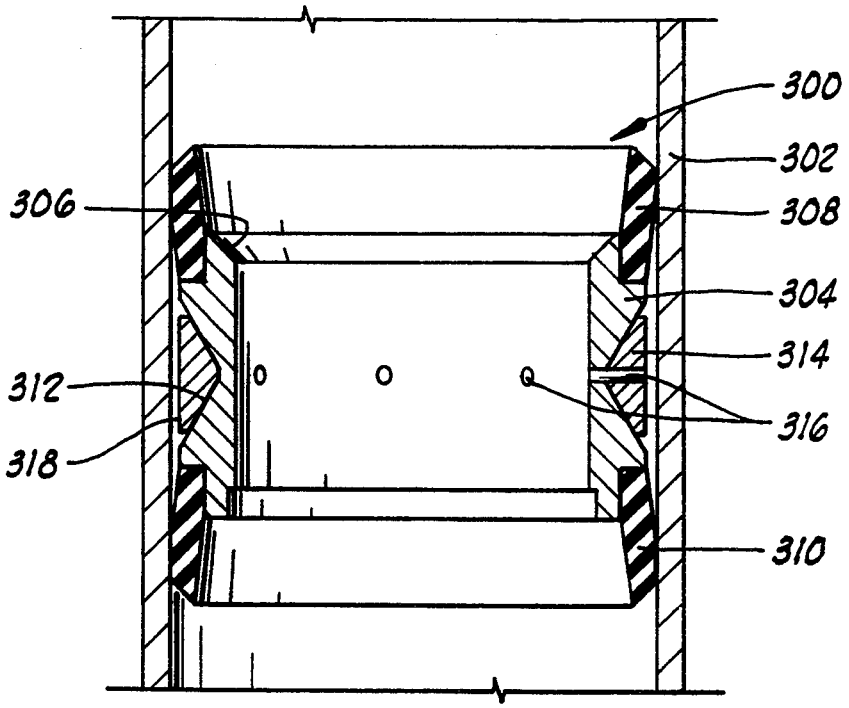
FIGS. 14 and 15 shows a fourth embodiment of the present invention.
Figure 15:
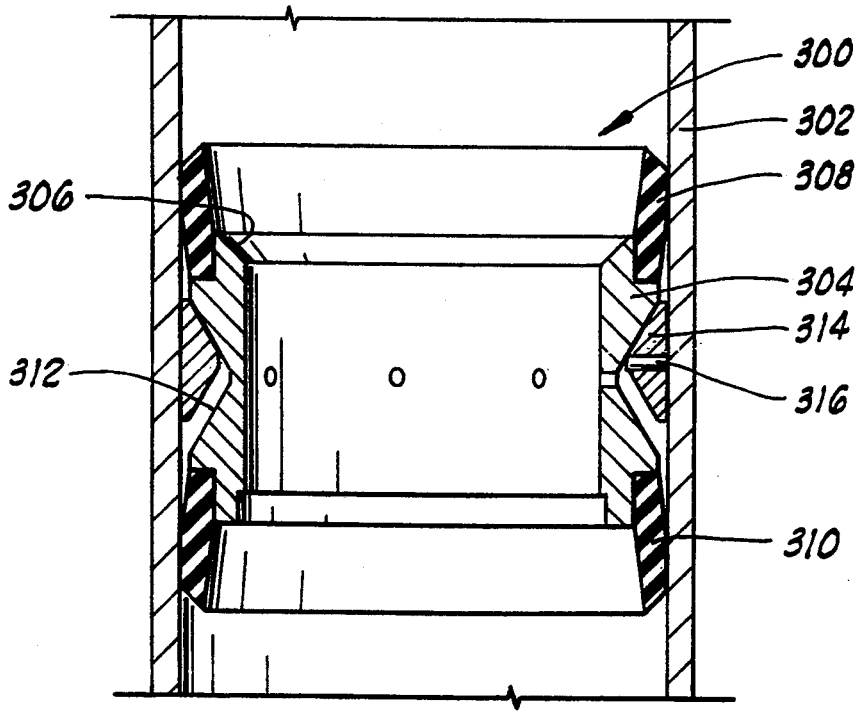

Referring now to FIGS. 14 and 15, a fourth embodiment wireline set baffle assembly is shown and generally designated by the numeral 300. Fourth embodiment 300 is positionable in a casing string 302. Fourth embodiment 300 is shown as it is run into casing 302 in FIG. 14. Although the setting or running tool is not shown in FIG. 14, it may be of the same or similar type as the setting or running tool 104 in the second embodiment shown in FIGS. 8–10. That is, the running tool for fourth embodiment 300 is of a kind generally known in the art, such as a GO or Baker wireline setting tool.

Fourth embodiment baffle assembly 300 comprises a baffle 304 having an upwardly facing chamfered surface 306 therein. A sealing means, such as upper seal 308 and lower seal 310, is attached to baffle 304 and provides sealing engagement between the baffle and casing 302.

An annular V-shaped groove 312 is defined on the outside of baffle 304 between upper seal 308 and lower seal 310. A radially outwardly biased lock ring 314 is disposed around baffle 304 and generally positioned in groove 312. Lock ring 314 is another embodiment of the engaging means for engaging well casing 302, as will be further described.

A shear means, such as a plurality of shear pins 316, hold lock ring 314 in a retracted position with respect to baffle 304 so that it cannot move outwardly and engage casing 302. Shear pins 316 thus characterize a retaining means for retaining lock ring 316 in the retracted position and, upon shearing, releasing the lock ring to a casing engaging position, as shown in FIG. 15, when fourth embodiment baffle assembly 300 is in a predetermined position in well casing 302.

A radially outer surface 318 of lock ring 314 is adapted for gripping engagement directly with an inner surface of well casing 302 and not necessarily a casing joint recess as with the other embodiments. Outer surface 318 may have a gritty texture to facilitate this gripping engagement. Additional embodiments of outer surface 318, although not illustrated, could include other known devices for gripping, such as grooves, teeth, etc. It will be seen by those skilled in the art that any of the other lock rings illustrated in the first, second, or third embodiments of the present invention could also be adapted to engage the inner surface of the casing and not necessarily be limited to engagement of a groove defined at a casing joint.

When fourth embodiment apparatus 300 is positioned at the desired location, the setting tool is fired in a manner known in the art. After firing, shear pins 316 are sheared which releases lock ring 314 so that it expands outwardly to engage casing 302 as illustrated in FIG. 15.

As with the other embodiments, a free-fall plug or ball may be dropped to engage chamfer 306 in baffle 304 so that fluid flow downwardly past the baffle is prevented. A method of fracturing using wireline set baffle apparatus 300 is similar to that for the other embodiments.

GENERAL OPERATION

Any of the embodiments of the wireline set baffle of the present invention would normally be set before or after a completion attempt on a lower zone in order to stimulate a subsequent upper zone. However, the present invention is not intended to be limited to such an operation. Another use could arise when it is desirable to temporarily seal off an open hole, a weak casing section, or unstimulated perforated interval from fluids injected or pumped at greater pressures than that expected below the wireline set baffle. Another use would be to permit placement of a cementing baffle in the casing string after the casing string has been run. This process would permit precise placement of fluids such as cement into perforations, to the end of open casing, or down to casing splits below the wireline set baffle. These fluids would be displaced below the baffle with displacement fluids pumped behind a standard cement displacement plug. The standard cement displacement plug would land on the baffle and give a positive pressure response at the surface. This is beneficial when separations of two fluids are required.

It will be seen, therefore, that the wireline set baffle apparatus of the present invention is well adapted to carry out the ends and advantages mentioned as well as those inherent therein. While presently preferred embodiments of the apparatus and steps in methods of use of the apparatus have been described for purposes of this disclosure, numerous changes in the arrangement and construction of parts in the apparatus and steps in the method may be made by those skilled in the art as encompassed within the scope and spirit of the appended claims.

What is claimed is:

1. An apparatus for use in a well casing, said apparatus comprising:

an annular baffle;

a setting tool engaged with said baffle and adapted for releasing said baffle at a predetermined location in said well casing; and engaging means for engaging said well casing and supporting said baffle at said predetermined location.

2. The apparatus of claim 1 wherein said setting tool comprises means for connecting to a wireline.

3. The apparatus of claim 1 wherein said engaging means is characterized by a lock ring disposed adjacent to said baffle for engaging said casing.

4. The apparatus of claim 3 further comprising retaining means for retaining said lock ring in a retracted position and releasing said lock ring to a casing joint engaging position when the apparatus is in said predetermined location in said well casing.

5. The apparatus of claim 4 wherein said retaining means is characterized by a shear pin.

6. The apparatus of claim 1 wherein said engaging means is adapted for engaging a casing joint in said well casing.

7. The apparatus of claim 6 wherein said engaging means is characterized by a lock ring disposed adjacent to said baffle for engaging a recess defined between adjacent casing sections forming a portion of said casing joint.

8. The apparatus of claim 7 further comprising retaining means for retaining said lock ring in a retracted position and releasing said lock ring to a casing joint engaging position when the apparatus is in said predetermined location in said well casing.

9. The apparatus of claim 8 wherein said retaining means comprises a lock ring retainer disposed around said lock ring for retaining said lock ring in said retracted position, said lock ring retainer being movable with respect to said lock ring for releasing said lock ring to said engaging position.

10. The apparatus of claim 9 wherein said retaining means is characterized by a shear pin initially holding said lock ring to said setting tool.

11. The apparatus of claim 1 wherein said engaging means is characterized by collet fingers extending from said baffle for engaging a recess defined between adjacent casing sections forming a portion of said well casing.

12. The apparatus of claim 11 further comprising retaining means for retaining said collet fingers in a retracted position and releasing said collet fingers to a casing joint engaging position when the apparatus is in said predetermined location in said well casing.

13. The apparatus of claim 1 further comprising retrieving means for disengaging said engaging means from said casing so that said baffle may be removed from said well casing.

14. The apparatus of claim 13 wherein:

said engaging means comprises a radially outwardly biased lock ring; and said retrieving means comprises a retrieving ring for engaging and radially inwardly compressing said lock ring.

15. The apparatus of claim 13 wherein:

said engaging means comprises radially outwardly biased collet fingers; and said retrieving means comprises a chamfered surface on said collet fingers, whereby applying an upward force on said collet fingers disengages said collet fingers from said recess.

16. The apparatus of claim 1 further comprising sealing means for sealing between said baffle and said well casing.

17. The apparatus of claim 1 further comprising a tool for engaging said baffle after said baffle is released at said predetermined location in said well casing.

18. The apparatus of claim 17 wherein said tool is characterized by a plug adapted for preventing fluid flow past said baffle.

19. The apparatus of claim 18 wherein said plug comprises a bypass passageway therein for bypassing fluid past said baffle when said plug is in a bypassing position.

20. The apparatus of claim 17 wherein said tool is adapted for latching engagement with said baffle.

21. A apparatus for use in a well casing, said apparatus comprising:

a baffle;

a running tool engaged with said baffle and adapted for positioning said baffle at a predetermined location in said well casing;

a lock ring disposed adjacent to said baffle and adapted for engaging said casing at said predetermined location when said lock ring is in a casing engaging position; and a lock ring retainer for initially retaining said lock ring in a retracted position.

22. The apparatus of claim 21 wherein:

said lock ring is adapted for engaging a casing joint at said predetermined location; and said casing engaging position is characterized as a casing joint engaging position.

23. The apparatus of claim 22 wherein said lock ring retainer has a plurality of collet fingers extending therefrom and adapted for engaging a casing joint adjacent to said casing joint at said predetermined location such that when said collet fingers are so engaged, an upward pull on said running tool will cause said baffle and lock ring to be moved upwardly, thereby disengaging said lock ring retainer from said lock ring so that said lock ring expands to said engaging position.

24. The apparatus of claim 22 wherein said running tool comprises a plurality of inwardly deflectable collet fingers thereon so that said running tool may be disengaged from said baffle when said lock ring is in said casing joint engaging position.

25. A apparatus for use in a well casing, said apparatus comprising:

a baffle;

a setting tool engaged with said baffle and adapted for positioning said baffle at a predetermined location in said well casing;

a lock ring disposed adjacent to said baffle and adapted for engaging said casing at said predetermined location when said lock ring is in a casing engaging position; and shearing means for initially retaining said lock ring in a retracted position and adapted for shearing in response to actuation of said setting tool such that said lock ring is freed to move to said engaging position.

26. The apparatus of claim 25 further comprising a retrieving ring attached to said baffle and adapted for engaging said lock ring in response to upward movement of said baffle, thereby retracting said lock ring from said engaging position so that said lock ring and baffle may be retrieved from said well casing.

27. The apparatus of claim 25 further comprising sealing means for sealing between said baffle and said well casing.

28. An apparatus for use in a well casing, said apparatus comprising:

a baffle comprising a plurality of outwardly biased collet fingers extending therefrom, said collet fingers being adapted for engaging the casing at a predetermined location when said collet fingers are in a casing engaging position; and a setting tool engaged with said baffle and adapted for positioning said baffle at said predetermined location, said setting tool comprising retaining means for retaining said collet fingers in said retracted position and releasing said collet fingers to said engaging position.

29. The apparatus of claim 28 wherein said baffle further comprises sealing means for sealingly engaging said well casing.

30. An apparatus for use in a well casing, said apparatus comprising:

a baffle;

a setting tool engaged with said baffle and adapted for releasing said baffle at a predetermined location in said well casing;

engaging means for engaging the casing at the predetermined location, said engaging means being characterized by collet fingers extending from said baffle for engaging a recess defined between adjacent casing sections forming a portion of said well casing; and retaining means for retaining said collet fingers in a retracted position and releasing said collet fingers to a casing joint engaging position when the apparatus is in said predetermined location in said well casing, said retaining means comprising:

a cover engaging and holding said collet fingers in said retracted position; and releasing means for disengaging said cover from said collet fingers so that said collet fingers are free to engage said recess.

31. The apparatus of claim 30 wherein said releasing means comprises a blasting cap for fracturing said cover when said blasting cap is fired.

32. An apparatus for use in a well casing, said apparatus comprising:

a baffle comprising a plurality of outwardly biased collet fingers extending therefrom, said collet fingers being adapted for engaging the casing at a predetermined location when said collet fingers are in a casing engaging position; and a setting tool engaged with said baffle and adapted for positioning said baffle at said predetermined location, said setting tool comprising retaining means for retaining said collet fingers in said retracted position and releasing said collet fingers to said engaging position, said retaining means comprising:

a cover engaging and holding said collet fingers in said retracted position; and releasing means for disengaging said cover from said collet fingers.

33. The apparatus of claim 32 wherein said releasing means comprises a blasting cap for fracturing said cover when said blasting cap is fired.

* * * * *